US005431302A

United States Patent [19]

Tulley et al.

[11] Patent Number: 5,431,302

[45] Date of Patent: Jul. 11, 1995

[54] DISPENSED LIQUID VOLUME CONTROL SYSTEM

[75] Inventors: Michael K. Tulley; Richard D. Paton, both of Edmonton, Canada

[73] Assignee: August Systems, Inc., Edmonton, Canada

[21] Appl. No.: 165,726

[22] Filed: Dec. 13, 1993

[51] Int. Cl.[6] ..... B67D 5/30; B67D 5/08

[52] U.S. Cl. ..... 222/14; 222/59; 222/505

[58] Field of Search ..... 222/52, 59, 60, 14–16, 222/40, 505; 73/861.42; 364/479, 144, 465; 137/624.11, 606; 141/198, 210, 311 R, 317

[56] References Cited

U.S. PATENT DOCUMENTS

| | | | |
|---|---|---|---|
| 3,638,832 | 2/1972 | Sauber et al. . | |
| 4,037,598 | 7/1977 | Georgi | 222/59 X |
| 4,105,138 | 8/1978 | Lehmann et al. . | |
| 4,226,343 | 10/1980 | Fling | 222/505 X |
| 4,934,566 | 6/1990 | Guerette | 222/505 X |
| 4,955,507 | 9/1990 | Kirschner et al. . | |
| 4,979,641 | 12/1990 | Turner | 222/59 X |
| 5,014,211 | 5/1991 | Turner et al. | 222/59 X |
| 5,022,557 | 6/1991 | Turner . | |
| 5,027,284 | 6/1991 | Senghaas et al. . | |
| 5,129,434 | 7/1992 | Whigham et al. | 222/52 X |

FOREIGN PATENT DOCUMENTS

| | | |
|---|---|---|
| 2-282097 | 11/1990 | Japan . |
| 2084546 | 4/1982 | United Kingdom . |

OTHER PUBLICATIONS

Control Technology, Inc., Garland, Tex., U.S.A.—a sales brochure.

Easybar Beverage Controls, Lake Oswego, Ore., U.S.A.—a sales brochure.

B.V.L. Controls Ltd., Laval, Quebec, Canada—a sales brochure.

*Primary Examiner*—Andres Kashnikow
*Assistant Examiner*—Kenneth R. DeRosa
*Attorney, Agent, or Firm*—Dennis T. Griggs

[57] ABSTRACT

An improved apparatus and method is provided for accurately dispensing a preselected volume of liquid. A flowmeter is provided to generate signals proportional to the flow of liquid through a faucet. A programmed microcomputer receives the flowmeter signals and controls the faucet. The residual volume of liquid (spill), which was dispensed after the faucet was last commanded to close, is stored and averaged with additional, previously stored spill amounts by the microcomputer. The average spill volume is used to anticipate the spill for the forthcoming pour. When the cumulative volume of liquid dispensed is equal to the preselected volume less the anticipated spill volume, the microcomputer signals the faucet to close, resulting in an accurate pour. In a another aspect, an improved beer dispensing head is provided. A spring-loaded conventional tap handle activates a sensor means in the head. A remote microcomputer receives a signal from the sensor and produces a controlling signal to activate a remote electro-pneumatic valve. The valve actuates a double-acting cylinder located in the head, which in turn actuates the faucet, dispensing beer.

3 Claims, 5 Drawing Sheets

DISPENSED LIQUID VOLUME CONTROL SYSTEM

FIELD OF THE INVENTION

The present invention relates to an apparatus and method for accurately dispensing a preselected volume of liquid using a microprocessor controlled faucet means, responsive to flowmeter measurements and calculations comparing a cumulative dispensed volume against the preselected volume desired less an anticipated spill volume, which will be dispensed after the faucet means is commanded to close. In another aspect, an improved beer dispensing head is provided using a conventional tap handle and electronic sensor means coupled with a microprocessor to an electro-pneumatic faucet actuating means.

BACKGROUND OF THE INVENTION

There are a number of liquid dispensing systems on the market. Beer taps are a common application of such dispensing systems which attempt to accurately dispense predetermined quantities of beer. The dispensing of a predetermined quantity of beer is referred to as a pour. Generally these systems comprise the following characteristics:

- a user interface means which is used to preselect a quantity of beer, as desired;
- a user activated means which initiates the pour;
- a faucet means which controls the flow of beer from a pressurized source;
- an actuator which is connected to the faucet means for opening and closing of the faucet means;
- a flowmeter which is located in-line between the faucet means and the beer source to provide a measure indicative of the quantity of beer which passes through the faucet means; and
- a programmable controller means which calculates the cumulative volume of beer dispensed, and produces a signal for closing of the faucet means, when a quantity of beer equal to the preselected quantity has been dispensed.

In U.S. Pat. No. 5,022,557 issued to Turner, a typical programmable controller, electromechanical beer dispensing system is disclosed. In Turner's system, conventional mechanically activated handle and faucet have been replaced with electronic switch means to achieve precise control of the dispensing action. The quantity of beer is cumulatively calculated during a pour using a flow metering means. The quantity of beer is continually compared against a look-up table of desired dispensed quantities by a programmable controller and a signal is generated to terminate the flow of beer when the desired quantity has been dispensed. A solenoid, associated with the faucet, receives the signal and acts to close off the flow of beer.

Turner does not necessarily achieve an accurately dispensed quantity of beer. There are physical and process aspects of the dispensing system which introduce variability in the quantities ultimately dispensed. Physical limitations of the faucet and the actuating means result in a delay in their response. After having received a command to close, the faucet permits a residual spilled quantity of beer to be discharged as it closes. An attempt to offset the look-up table value by the amount of the spill fails to compensate reliably. Changes in the physical condition and response of the faucet, and process variability, such as the pressure of the beer source, dynamically affect the quantity of the spill.

In another aspect, Turner does not permit an operator to repeatedly interrupt and re-start the flow of liquid without losing track of the cumulative quantity of beer dispensed. Beer dispensed prior to an interruption is designated as waste. Particularly with respect to dispensing beer, foaming can occur which can be controlled somewhat by temporarily interrupting the flow. The apparatus of Turner comprises an actuating electrical solenoid associated with the faucet which tends to warm the exiting beer, further exacerbating foaming.

When the liquid being dispensed, such as beer, has a significant commercial value, and is dispensed frequently in small quantities, the effect of the residual spill quantity can be economically significant and detrimental.

It is therefore an object of the invention to provide means for accurately dispensing a preselected quantity of liquid in spite of repeated interruption and re-starting of the liquid flow, having accounted for variable spill quantity.

It is a further object of the invention to provide a beer dispensing system which uses a traditional beer tap handle to activate the system and yet still achieve an accurate pour.

SUMMARY OF THE INVENTION

The invention relates to a micro-computer controlled system to accurately dispense a preselected volume of liquid.

In one aspect of the invention, an improved dispensing system is provided. A flowmeter is located between a liquid source and a faucet. The flowmeter produces signals proportional to the flow of liquid therethrough. A microcomputer receives and processes the flowmeter signals to calculate the cumulative volume of liquid which is dispensed while the faucet is open. Additionally, the computer processes the flowmeter signals to calculate values indicative of a residual spilled volume of liquid which is dispensed after the computer signals the faucet to close. The computer stores an array of values, each being indicative of the spill volume which occurred after previous closures of the faucet. The computer calculates an average spill volume from the array of values, accurately anticipating the spill volume of the next faucet closure despite it being affected by variables such as the physical condition of the faucet and the pressure of the liquid source. When the accumulated volume is equal to the preselected volume less the average spill volume then the computer signals the faucet to close.

In another aspect, an improved beer dispensing tap is provided. The operation and load-resisting "feel" of a manual beer tap handle, desirable to the user, is combined with a microcomputer controlled faucet means. Accuracy of the dispensed beer quantity is improved over conventional beer taps.

A conventional beer tap handle and lever assembly is provided comprising a spring-loaded lever mounted atop the dispensing tap. The lever assembly activates an electronic switch when manipulated. The switch produces signals which are processed by the microcomputer, which in turn opens and closes a faucet to dispense a preselected volume of beer. The user preselects the desired portion from a multi-switch faceplate mounted to the head which is interfaced with the microcomputer. The faucet is comprised of a conventional valve body and a custom tap shaft adapted to control the flow of beer through the valve body. Preferably the tap shaft is teflon coated to prevent sticking.

When the microcomputer determines that the appropriate volume of beer has been dispensed, it produces a signal to activate the closing of the faucet. The signal activates a electro-pneumatic valve which directs air to actuate a double acting pneumatic cylinder located at the dispensing head. The pneumatic cylinder actuates a lever assembly which opens or closes the faucet as directed by the computer. When open, beer flows from a pressurized source, out of the faucet, and into a suitable container.

DETAILED DESCRIPTION OF THE PREFERRED EMBODIMENT

Figure 1:
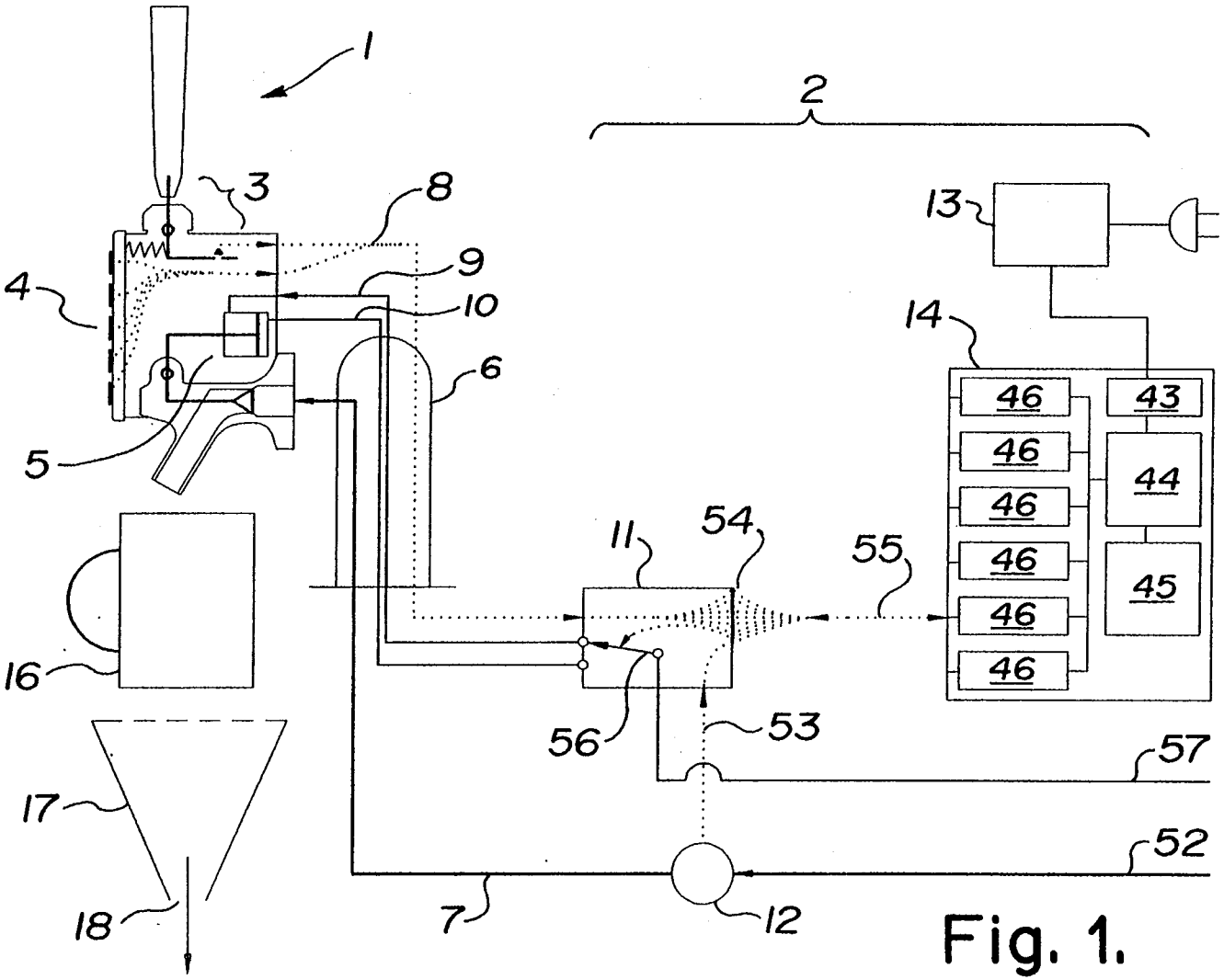
FIG. 1 is a schematic of the beer portion control system.

Having reference to FIG. 1, a dispensed liquid volume control system is provided. Specifically, as applied to the dispensing of beer, the system comprises a dispensing head 1 and a control system 2.

The dispensing head 1 comprises user-activated switch means 3 and portion preselecting means 4, and a control system actuated faucet assembly 5.

The dispensing head 1 is supported from a pedestal 6 which is preferably cooled. The pedestal 6 harbors a beer supply line 7, and cable 8 and pneumatic lines 9, 10 which transmit signals between the dispensing head 1 and the control system 2.

The control system 2 comprises a pneumatic switching assembly 11, a flowmeter 12, a power supply 13, and a microprocessor based control center 14. The control center 14 evaluates information from the dispensing head 1 and the flowmeter 12 and accordingly actuates the pneumatic switch assembly 11. The pneumatic switch assembly 11 appropriately directs the faucet assembly 5 to dispense, or not to dispense beer into a suitable container 16. The container 16 is positioned over a drain 17 to direct excess beer to waste 18.

Figure 2:
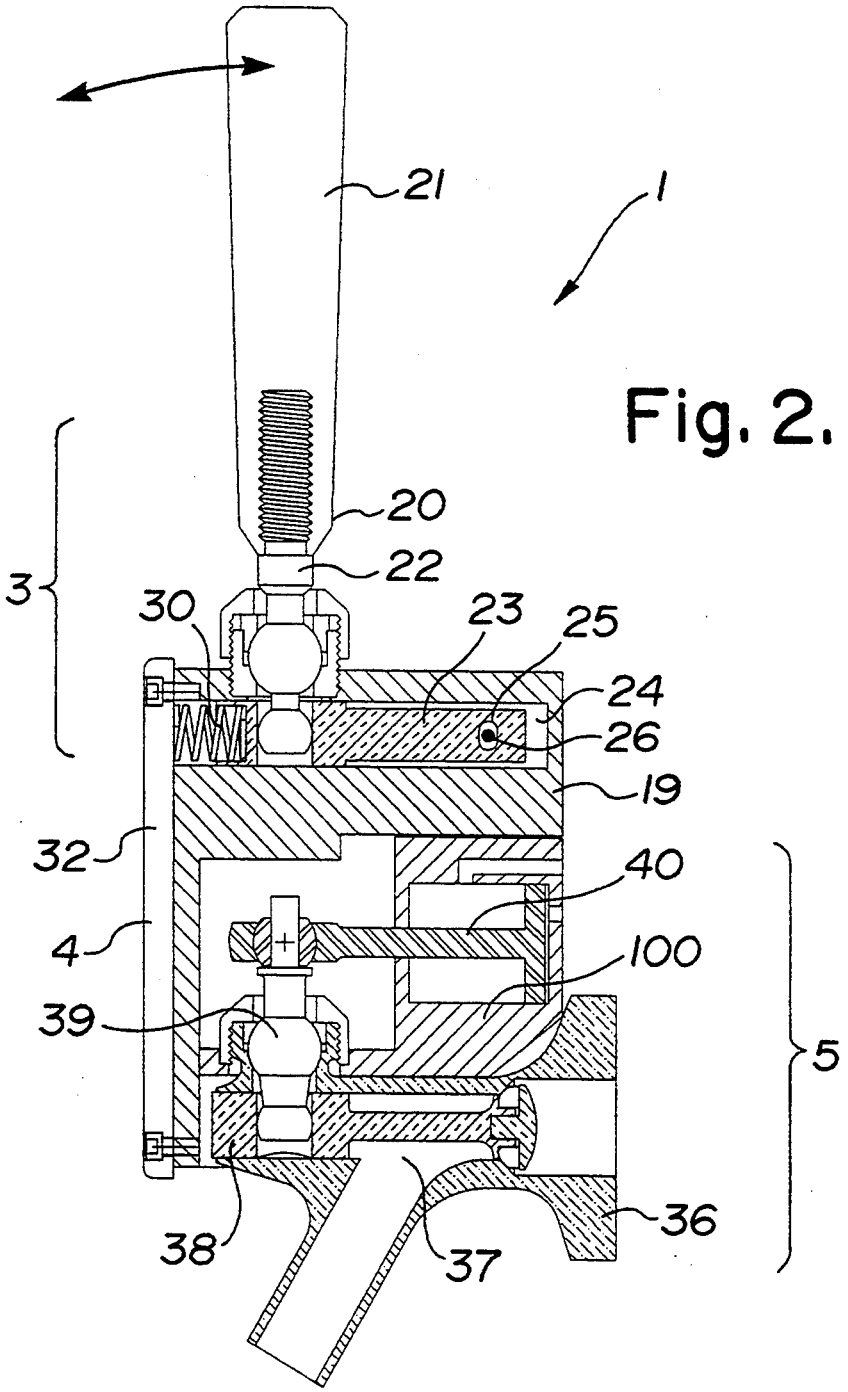
FIG. 2 is a cross section of the assembled dispensing head.
Figure 3:
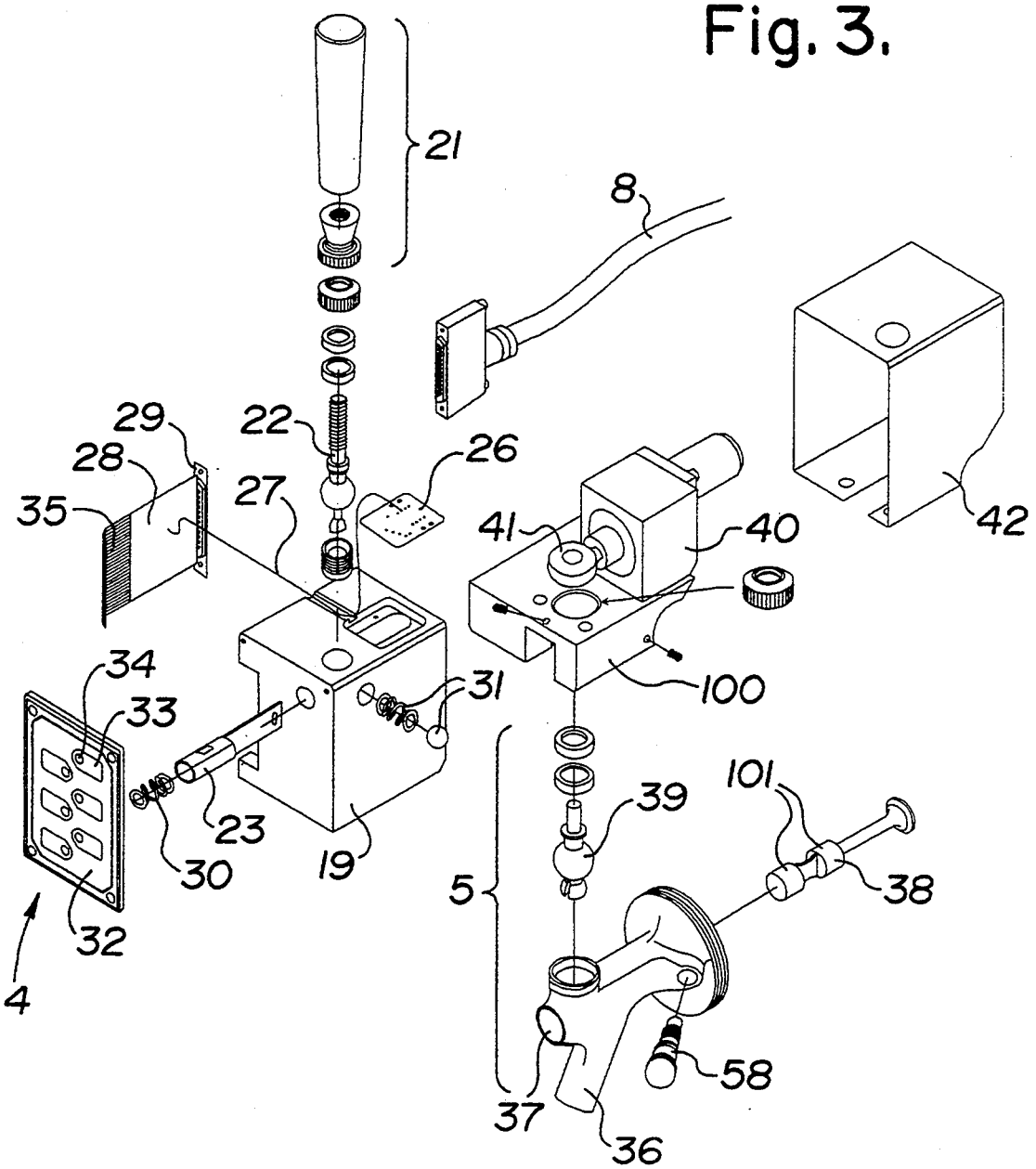
FIG. 3 is an perspective, exploded view of the dispensing head.

Referring now to FIGS. 2 and 3, the dispensing head 1 is described in greater detail. The switch means 3 is mounted within a main block portion 19 of the head 1 and is actuated with a user-activated lever assembly 20.

The lever assembly 20 comprises a conventional beer tap handle 21 screwed to an actuating lever 22. The actuating lever 22 is rotatively mounted to the main block 19 and is slidably engaged to a cylindrical sensor shaft 23. The sensor shaft 23 is axially moveable within a cylindrical cavity 24 in the main block 19. A port 25 in the sensor shaft 23 cooperates with an electronic sensor 26 to produce signals indicative of the position of the sensor shaft 23, lever 22 and tap handle 21. A suitable sensor is a Printed Circuit Board (PCB) mounted optical sensor available from Motorola and designated as model #H21A1. The sensor 26 is secured to the top of the main block 19. Signals produced from the sensor 26 are transmitted through cable 27 to a tap PCB 28 and a multi-conductor connector 29 (DB-25 D-type) projecting from the rear face of the main block 19.

The sensor shaft 23 is loaded with a spring 30 to provide a desirable load-resisting mechanical feedback or "feel" at the tap handle 21 when activated with a pull forwards. The spring 30 returns the lever assembly 20 from the 'halt' position to an upright neutral position (FIG. 2) when released. A spring-loaded detent means 31 is engaged at the neutral position.

The portion preselecting means 4 is comprised of a custom membrane switch faceplate 32 having a plurality of function switches 33 and status indicators 34. The faceplate 32 is attached to the front face of the main block 19. Each function switch 33 produces an individual electrical signal, uniquely identifying the switch selected by the user. A ribbon cable 35 connects each function switch 33 to the tap PCB 28 and to the electrical connector 29. Each function switch 33 enables the user to select one of several pour volumes or portions, such as a glass, mug, pony, pitcher or other special volume, or to select a stop request.

The faucet assembly 5 comprises a conventional valve body 36 as supplied by the Perlick CO., Millwaukee, Wis., shown as model 307 SER Flo-Control. The valve body 36 is secured to a lower block 100. The valve body 36 has a passageway 37 which is fitted with a custom stainless steel tap shaft 38. Actuation of the tap shaft 38 controls the flow of beer through the passageway 37. Preferably a teflon coating 101 is applied to the surface of the tap shaft 38 to prevent sticky operation due to the seepage of beer, inherent to the valve body 37 and tap shaft 38 design.

A tap shaft actuating lever 39 is rotatively mounted to the lower block 100 for actuation of the tap shaft 38. A double acting pneumatic actuator 40 is also secured to the lower block 100 for bidirectional actuation of the tap actuating lever 39. A suitable pneumatic actuator is that supplied by SMC Pneumatics Inc, of Indianapolis, Ind., cylinder kit model number CQ2B20-10D. A custom rod end 41 pivotally connects the pneumatic actuator 40 and the tap actuating lever 39. The pneumatic actuator 40 produces sufficient force on the tap actuating lever, to ensure either opening of closing actuation of the tap shaft, regardless of the condition of the faucet assembly.

The lower block 100 is secured by screws to the main block 19 and is covered with a protective wrapper 42.

Figure 4:
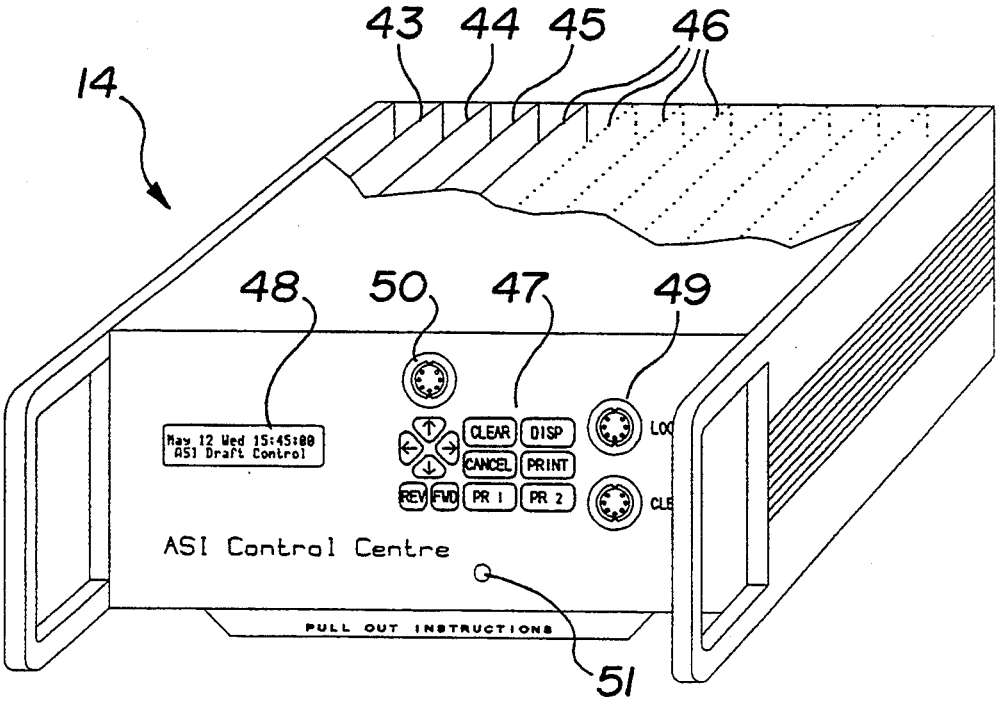
FIG. 4 is a perspective view of the control center.

Having reference to FIGS. 1 and 4, the control center 14 comprises a power conditioning board 43 which conditions power from the power supply 13 and distributes it to a central microprocessing unit (CPU) 44, a user display console board 45 and one or more tap interface boards 46. The CPU 44 is capable of directing multiple tap interface boards 46 that are provided for each dispensing head 1 of a multi-tap installation. Each dispensing head 1 requires a separate pneumatic switch assembly 11 and flowmeter 12. Many ways for implementing the CPU 44 are known and are generally understood to comprise processing and timing circuits, and volatile (RAM) and read-only memory (ROM) storage means.

The control center 14 has a CPU keypad interface 47, a electronic display 48 (such as an LCD display), and on/off and programming access key-switches 49, 50. A IR port 51 provides an interface to an optional printing device (not shown).

Referring again to FIG. 1, line 7 directs beer through the flowmeter 12 from a pressurized beer supply 52 to the faucet assembly 5.

The flowmeter 12 generates electrical signals proportional to the rate of flow of the beer passing therethrough. A cable 53 from the flowmeter 12 enables transmission of the generated signals to the control center 14. A suitable turbine style flowmeter is that supplied by Hedland, model #502-128.

Both the flowmeter and the dispensing head cable 53, 8 are connected through the pneumatic switching assembly 11 at a convenient connecting junction 54.

The control center 14 is connected to the junction 54 with cable 55 to receive signals and to transmit controlling signals to the faucet assembly 5.

The pneumatic switching assembly 11 is comprised of an electro-pneumatic valve 56. A suitable solenoid actuated pneumatic valve is supplied by SMC Pneumatics, Inc, model number NVJ3140-5LZ. An air supply 57, at about 45 psig, provides powering air to the pneumatic valve 56. Control signals from the control center 14 activate the electro-pneumatic valve 56 to direct air to lines 9, 10 for closing and opening of the faucet assembly 5 respectively. The electro-pneumatic valve 56 is purposefully remote from the faucet assembly to avoid the aforementioned disadvantages of the exothermic nature of electrical solenoids on the foaming of beer.

In operation, the control system 2 and the dispensing head 1 cooperate to dispense an accurate volume of beer to the container 16. A significant impediment to accurate determination of the volume dispensed is the variability of the residual volume of beer, or spill, which is dispensed during a delay interval in time between receipt of a control center 14 closing signal and the actual physical closing of the faucet assembly 5. The volume of the spill, and ultimately the total volume of beer which issues from the faucet assembly 5 is a function of many variables such as: user adjustment of an optional passage restriction valve 58 in the valve body 36; the pressure of the beer supply 52; the resistance of the tap shaft 38 to movement; and the pneumatic air pressure.

The spill which is dispensed during the delay interval, is measured using the flowmeter 12. This spill amount, as recorded and stored for multiple previous closures of the faucet assembly 5, is used to anticipate the spill for the next successive pour. The control center 14 accumulates the volume of beer dispensed, and by anticipating the amount that will spill after initiating the closure of the faucet assembly, achieves a more accurate pour.

Figure 5:
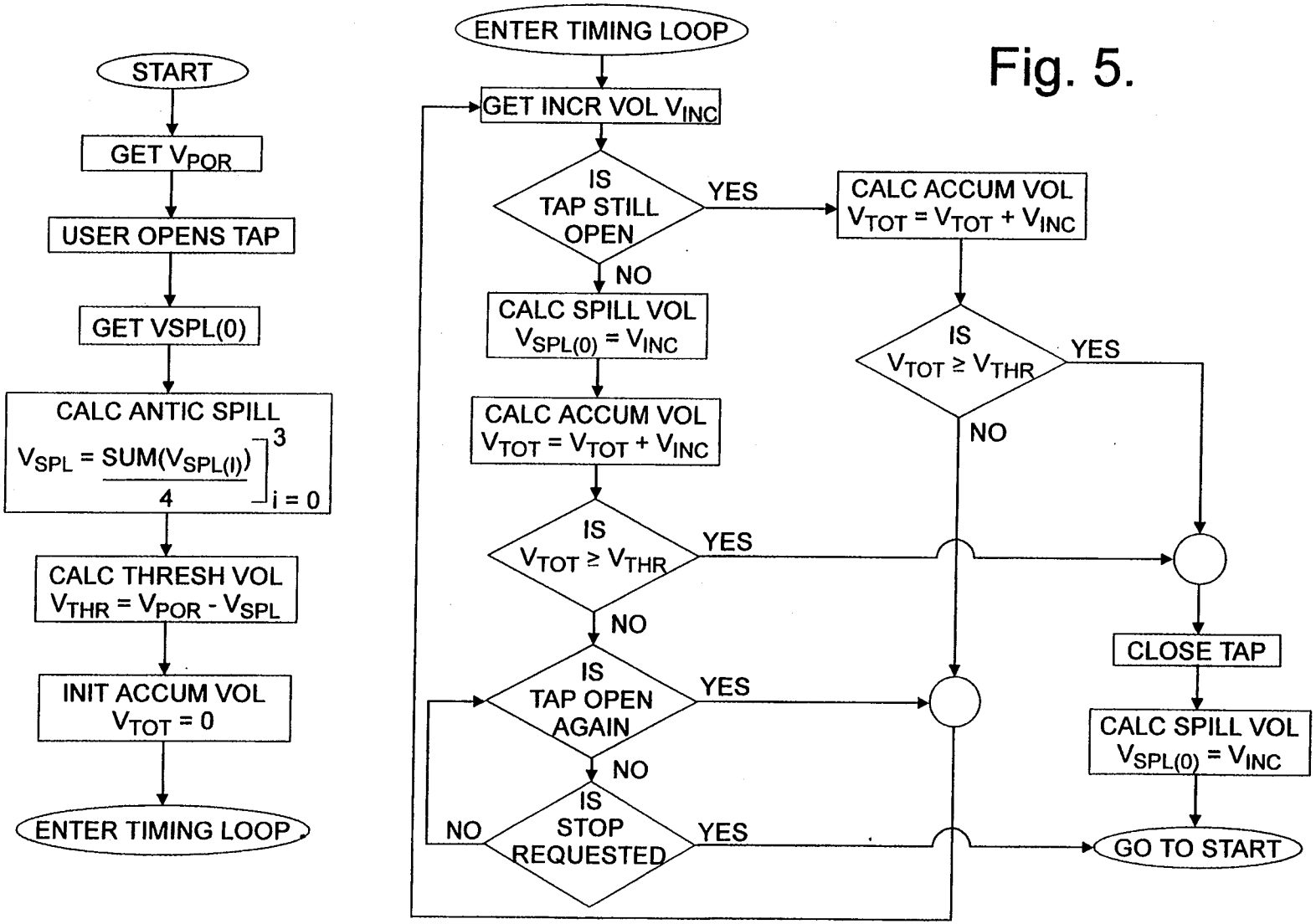
FIG. 5 is a simplified flow diagram of the CPU programming.

More particularly, having reference to FIGS. 1 and the simplified flow chart of FIG. 5, the following steps are performed during a pour.

The user preselects a desired pour volume ($V_{por}$) by activating the appropriate switch 33 on the faceplate 32, transmitting the signal to the CPU 44. The user then manipulates the tap handle 21, signalling to start the pour.

The spill volume ($V_{spl}[0]$) from the previous closure of the faucet assembly is retrieved from the CPU. The spill $V_{spl}[0]$ is averaged with several earlier stored spill amounts ($V_{spl}[i]$, usually for $i=1$ through 3) to calculate an average spill volume ($V_{spl}$). The average spill volume is the anticipated dispensed volume which will occur at the conclusion of the current pour.

The user requested volume of the pour ($V_{por}$) is retrieved from CPU storage. A threshold volume ($V_{thr}$), representing the desired dispensed volume less the spill volume, is calculated as $V_{por}-V_{spl}$.

A timing loop is initiated to process the flowmeter signals. The total volume of beer dispensed thus far is initialized to zero $V_{tot}=0$ and a logical timing loop is started. For each cycle of the timing loop, the CPU cumulatively sums the incremental volume of beer dispensed ($V_{inc}$) through the flowmeter.

If the switch means 3 remains activated, then dispensing head (beer tap) is still open. The CPU calculates the total volume dispensed thus far $V_{tot}=V_{tot}+V_{inc}$ and compares this against the threshold volume $V_{thr}$. If the threshold volume is achieved $V_{tot}>V_{thr}$ then the CPU 44 signals the pneumatic valve 56 to close the faucet assembly 5. After a delay interval, the faucet assembly physically closes, having added a spill volume of beer $V_{spl}[0]$ to the threshold volume $V_{thr}$ already dispensed. If actual spill volume dispensed $V_{spl}[0]$ was substantially equal to the anticipated volume $V_{spl}$, then the total volume dispensed $V_{tot}$ is now substantially equal to the requested pour size $V_{por}$. In other words, beer is dispensed into the container, equal to the threshold volume less the anticipated spill volume. After the spill volume is included, an accurately dispensed volume of beer is achieved and the pour is concluded.

The volume of beer that is dispensed after the signal to close the valve is transmitted is stored as the newest spill volume $V_{spl}[0]$ for the next successive pour.

The CPU performs additional logical testing which permits the tap handle to be "played" by the user to control foaming and the like. If the switch means 3 should indicate that the tap is closed, then the CPU ascertains if enough beer has been dispensed or if this is simply an interruption. The CPU updates the spill amount $V_{spl}[0]$, and the total accumulated volume $V_{tot}$. The accumulated volume $V_{tot}$ is compared against $V_{thr}$. If insufficient volume is dispensed thus far, then the loop waits for the user to again open the tap or to cancel the pour with a stop request.

The CPU is programmed to provide accounting and maintenance features. The CPU will recognize a separate cleaning operation, permitting the passage of unrestricted volumes of cleaning fluids. Reports can be generated including: the total volume and number of pours for each of multiple taps; the value of beer sales at each of several price levels; and the time and date of the last cleaning operation.

In summary, the invention is characterised by the following advantages:

- on-going compensation for variability in residual spill volumes, resulting in more accurate liquid volumes dispensed;
- capability to account for repeated interruption and re-starting of liquid flow;
- provide the user-desirable "feel" of a traditional mechanical beer tap, yet continue to provide the dispensed volume accuracy of a microcomputer controlled system.
- using pneumatic faucet actuating means, thereby avoiding exacerbating the foaming of beer as is the case with exothermic solenoid actuating means.

The embodiments of the invention in which an exclusive property or privilege is claimed are defined as follows:

1. A liquid volume control system, for the accurate dispensing of an preselected volume of liquid, comprising:

a pressurized source of liquid;

a faucet means connected to the liquid source, for controlling dispensing of the liquid therethrough;

a flowmeter means, connected between the liquid source and the faucet means, for producing signals proportional to the flow of liquid dispensed from the faucet means;

an actuating means for opening and closing the faucet means;

switch means for producing signals to initiate dispensing of the liquid;

a programmable controller means being connected to the switch means and the flowmeter means for receiving the signals produced therefrom and continuously establishing from said signals first values indicative of the cumulative volume of liquid dispensed and second values substantially indicative of the average spill volume, and for comparing the first and second calculated volume values with the preselected volume, and sending a signal to the actuating means to close the faucet means when the calculated cumulative volume of liquid dispensed is equal to the preselected volume less the average spill volume, whereby the total of the cumulative volume and an actual spill volume dispensed is substantially equal to the preselected volume.

2. The control system as recited in claim 1 wherein the dispensed liquid is beer.

3. In a computerized beer dispensing system for the dispensing of a preselected quantity of beer, having a faucet means connected with a pressurized source of beer, said faucet means having a flowmeter means connected thereto to produce signals indicative of the volume of beer flowing therethrough, the improvement comprising:

a beer tap handle for user activation of the dispensing system;

a electronic switch means for producing signals indicative of the beer tap handle position;

a lever means for activating the switch means, being connected to the beer tap handle, and having spring return and detent means to provide a user-desirable mechanical feedback;

actuating means for opening and closing the faucet means;

a programmed computer means for receiving the handle position signal to produce controlling signals for activating the actuating means to open the faucet means when the lever is pulled forward and to close the faucet means when the handle is returned, and also to receive flowmeter signals to calculate values indicative of the cumulatively dispensed quantity of beer, compare them with stored values indicative of the preselected quantities and to produce signals to activate the actuating means to close the faucet means, causing the faucet means to dispense the preselected quantity of beer.

* * * * *